United States Patent [19]

Hanson et al.

[11] Patent Number: 4,498,863

[45] Date of Patent: Feb. 12, 1985

[54] FEED FORWARD COMBUSTION CONTROL SYSTEM

[75] Inventors: Robert C. Hanson, Excelsior; Leon C. Hanson, Bloomington, both of Minn.

[73] Assignee: Hays-Republic Corporation, Riviera Beach, Fla.

[21] Appl. No.: 496,337

[22] Filed: May 23, 1983

Related U.S. Application Data

[63] Continuation of Ser. No. 253,713, Apr. 13, 1981, abandoned.

[51] Int. Cl.[3] ..... F23N 1/00

[52] U.S. Cl. ..... 431/89; 431/90

[58] Field of Search ..... 431/89, 90, 12; 236/14, 236/15 BD; 60/39.29; 137/110, 114; 123/478, 480; 73/861.02, 861.03

[56] References Cited

U.S. PATENT DOCUMENTS

| | | | |
|---|---|---|---|
| 2,954,692 | 10/1960 | Hornfeck | 73/861.02 |
| 3,049,300 | 8/1962 | Lewis et al. | 431/12 |
| 3,284,615 | 11/1966 | Yetter | 236/14 |
| 3,357,473 | 12/1967 | Blackett et al. | 431/90 |
| 3,549,089 | 12/1970 | Hamlett | 431/12 |
| 3,607,117 | 9/1971 | Shaw | 236/15 BD |
| 4,043,742 | 8/1977 | Egan et al. | 431/90 |
| 4,118,172 | 10/1978 | Noir et al. | 431/90 |
| 4,125,093 | 12/1978 | Platzer | 431/90 |
| 4,144,997 | 3/1979 | Anderson et al. | 431/90 |
| 4,249,886 | 2/1981 | Bush | 431/90 |
| 4,309,168 | 11/1982 | Prill et al. | 431/12 |
| 4,332,226 | 6/1982 | Nomura et al. | 123/478 |
| 4,348,169 | 9/1982 | Swithenbank et al. | 431/89 |
| 4,357,923 | 11/1982 | Hideg | 123/480 |
| 4,369,026 | 1/1983 | Morgan et al. | 431/89 |

*Primary Examiner*—Samuel Scott
*Assistant Examiner*—Noah Kamen
*Attorney, Agent, or Firm*—Woodcock, Washburn, Kurtz, Mackiewicz & Norris

[57] ABSTRACT

A feed forward control system maximizes combustion efficiency in a combustion system, by controlling the amount of excess air supplied to the burner. The feed forward control system includes flow sensors for sensing the flow of air and fuel to the burner. Based upon the fuel flow measurement, a digital computer determines the correct stoichiometric amount of combustion air required and the firing rate of the burner. Based upon the firing rate, the digital computer determines, from stored data in a look-up table, the necessary excess air required. Based upon the stoichiometric combustion air and the excess air, the computer determines the actual air that is required. This air required is then compared with the air flow measurement received by the digital computer. Based upon this comparison, an air trim actuator is driven by the computer until the required air flow is attained.

7 Claims, 1 Drawing Figure

FEED FORWARD COMBUSTION CONTROL SYSTEM

This is a continuation of copending application Ser. No. 253,713, filed Apr. 13, 1981, abandoned.

BACKGROUND OF THE INVENTION

1. Field of the Invention

The present invention relates to combustion control system. In particular, the present invention relates to a dynamic feed forward system for controlling flow of air supplied to a burner to maximize combustion efficiency.

2. Description of Prior Art

The need for maximizing combustion efficiency in all types of combustion firing operations is of major importance. The waste of energy through inefficient combustion can no longer be tolerated in view of high costs and limited quantities of fossil fuel.

In a typical fuel combustion system, there is a certain amount of air required for efficient and complete combustion. If this amount is too little, combustion will be incomplete. The unburned fuel results in loss of efficiency, smoke emission, and possible creation of an explosive mixture. Too much air increases the total mass flow through the system and thus increases the amount of heat lost in the flue gas.

To avoid the problems which result when too little air is supplied, combustion systems are typically set on the "safe" side with a high percentage of excess air (in excess of the stoichiometric amount of air required for complete combustion) entering the system. The cost of heating this additional excess air, however, is significant. Any additional air above the minimum required value increases total mass flow through the system and carries away unused heat. The additional excess air also reduces flame temperatures in the boiler or burner and results in less heat absorption in the furnace and higher stack temperatures.

There is a continuing need for a combustion control system which will operate a particular combustion system so that the combustion system fires with a minimum of excess air over a wide firing range. The combustion control system should be capable of operation with a wide variety of combustion equipment, and should be capable of use not only in new systems, but in retrofit control systems.

In the past, although some specialized combustion control systems have been developed for particular combustion equipment, there has remained a need for a highly flexible combustion control system which is useable with a wide variety of different combustion equipment.

SUMMARY OF THE INVENTION

The combustion control system of the present invention control excess air provided to a burner of a combustion system on a dynamic feed forward basis, as a function of fuel flow and air flow. The system of the present invention includes a digital computer which receives signals representative of the rate of fuel flow and of the rate of air flow, and supplies control signals to an air trim actuator, which controls the flow rate of air entering the burner.

The digital computer determines the firing rate of the combustion system based upon the measured fuel flow. The digital computer has stored data indicating the desired excess air required based upon the firing rate.

Based upon this excess air value and the stoichiometric amount of combustion air (which is determined from the fuel flow measurement), the digital computer determines the required amount of combustion air. This required amount is compared to the air flow measurement, and based upon the comparison, the digital computer controls the operation of the air trim actuator so that the measured air flow matches the required air flow.

BRIEF DESCRIPTION OF THE DRAWING

FIG. 1 is a block diagram illustrating a combustion control system including the feed forward excess air control of the present invention.

DETAILED DESCRIPTION OF PREFERRED EMBODIMENTS

Figure 7:
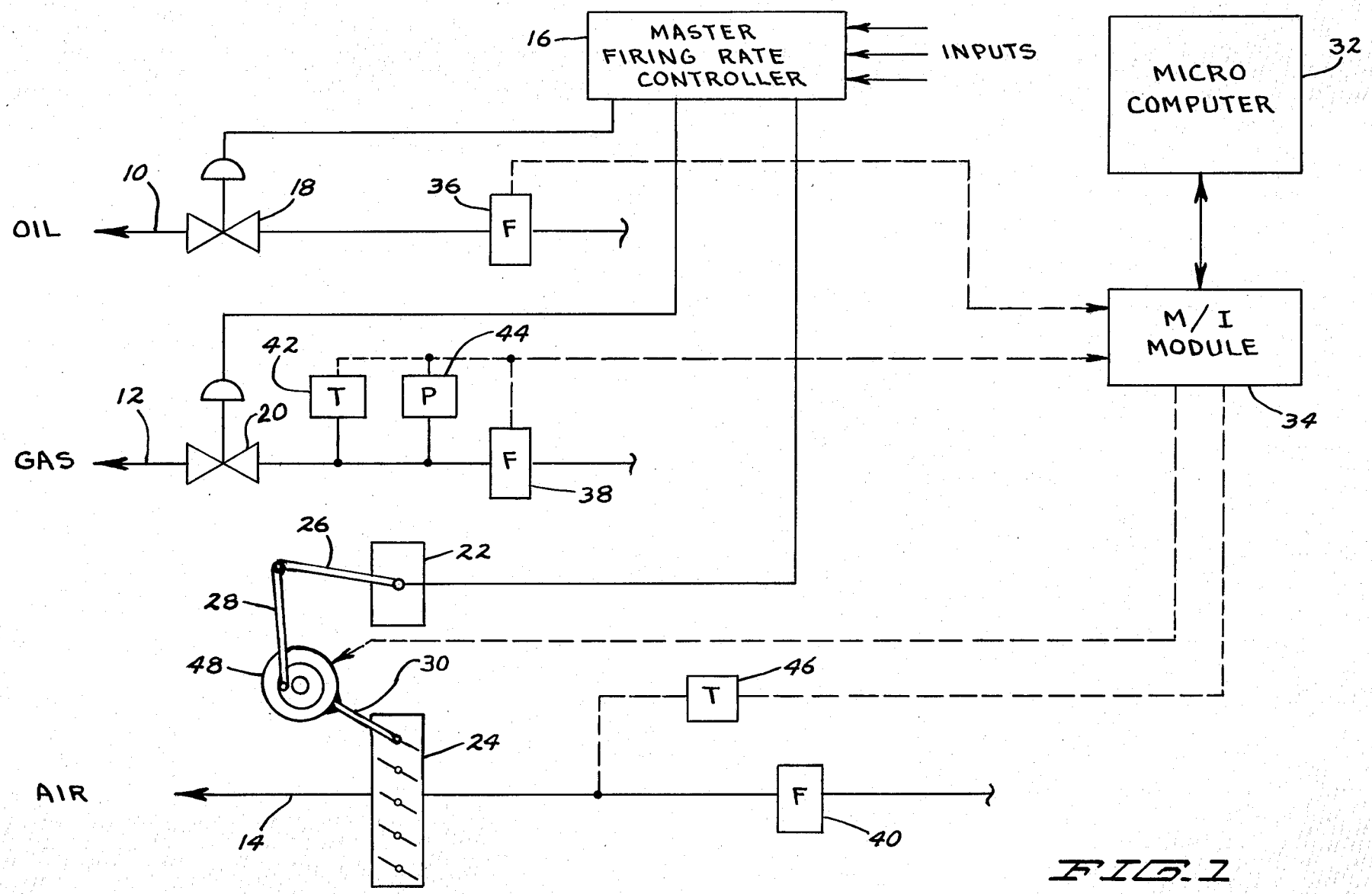

In FIG. 1, a pneumatic master steam pressure control system for a combustion system is shown. Oil, gas, and air are supplied to a burner (not shown) by supply lines 10, 12, and 14, respectively. Master firing rate controller 16 supplies pneumatic control signals independently to oil control valve 18, gas control valve 20, and air control damper actuator 22. Oil control valve 18 controls the flow of oil through line 10 to the burner. Similarly, gas control valve 20 controls flow of gas through line 12 to the burner. Air control damper actuator 22 controls the position of air damper 24 through mechanical linkages 26 and 28 and trim actuator and mounting arm 30, and thus controls the flow of air through line 14 to the burner.

In the system shown in FIG. 1, master firing rate controller 16 determines the set points of valves 18 and 20 and actuator 22 based upon various inputs which may include, for example, steam pressure, temperature, flame safeguard inputs and control settings. The feed forward excess air trim control of the present invention includes microcomputer 32, microinterface module 34, oil, gas and air flow meters 36, 38, and 40, respectively, gas temperature sensor 42, gas pressure sensor 44, air temperature sensor 46, and excess air trim actuator 48. Microcomputer 32 includes a central processing unit and both program and data memory. Signals to microcomputer 32 and control signals from microcomputer 32 are supplied through microinterface module 34.

Oil flow meter 36 supplies an oil flow measurement signal to microcomputer 32. Similarly, gas flow meter 38 supplies a gas flow measurement signal to microcomputer 32. Temperature sensor 42 and pressure sensor 44 supply temperature and pressure measurement signal indicative of the temperature and pressure of the gas flowing in line 12. These signals are used to correct the flow measurement signal supplied by flow meter 38. Air flow meter 40 supplies an air flow measurement signal to microcomputer 32. This air flow measurement signal is corrected for temperature based upon the air temperature measurement signal supplied by temperature sensor 46.

The output of microcomputer 32 is a control signal which is supplied to electric air trim actuator 48. This control signal causes air trim actuator 48 to vary the position of damper 24, and thus control the flow of air through line 14 to the burner. This air trim control signal supplied by microcomputer 32 is a function of the input signals received from sensors 36, 38, 40, 42, 44 and 46, and data memory information which is stored by microcomputer 32.

The control of air trim actuator 48 is on a dynamic feed forward basis. Microcomputer 32 first examines the fuel flow measurement signal from either oil flow meter 36 or gas flow meter 38 (depending upon on whether oil or gas is being supplied). If gas is being supplied, the fuel flow measurement signal from flow meter 38 is temperature and pressure corrected by microcomputer 32, and the corrected fuel flow measurement signal is used to determine the correct stoichiometric amount of combustion air required. This stoichiometric air amount is stored temporarily by microcomputer 32 in a memory register. Microcomputer 32 then determines the firing rate based upon the fuel flow measurement.

Microcomputer 32 has stored in a look-up table a plurality of excess air set points for each fuel firing range. Based upon the firing rate which has been determined, microcomputer 32 accesses the look-up table and determines the excess air value which is required. Microcomputer 32 then determines the total amount of air flow required in line 14 by adding the excess air value to the previously calculated stoichiometric combustion air value.

The actual air flow measurement from air flow meter 40 is then compared by microcomputer 32 to the required air flow value. Based upon this comparison, corrective action is taken by microcomputer 32. In a preferred embodiment, the output signal supplied by microcomputer 32 through microinterface module 34 to air trim actuator 48 is a proportional pulse duration signal. If the required and actual air flow values are widely different, the pulse duration as supplied to air trim actuator 48 is relatively great. As adjustment is made, and the measured air flow approaches the required air flow, the pulse duration becomes less. This effectively slows the adjustment as the desired value of air flow is achieved.

Because the air flow is always controlled to exact requirement, an equal percentage control action is provided by the system of the present invention. Air trim actuator 48 is controlled so that the air flow supplied matches the required air flow, regardless of whether the system has high or low firing rate. This is an important consideration in low excess air firing. If this system were not trimming excess air on an equal percentage basis, a varied degree of trim, on an equal percentage basis over the firing range would result.

In prior art conventional analog feedback systems, in which trim control is a function of sensed oxygen in the flue gas, equal percentage correction is typically not obtained. In other words, in such a prior art system, the same excess oxygen deviation at a high firing rate results in the same trim action as for a low firing rate even though greater correction is required at a high firing rate than at a low firing rate in order to obtain the same effect. As a result of this non-equal percentage control, the prior art feedback systems provide a wide band of control which requires an air flow control set point which is higher than necessary.

In contrast, the dynamic feed forward system of the present invention controls fuel/air ratio at the point of combustion. Because actual air and fuel flow are known, the amount of corrective action taken results in an equal percentage control regardless of firing rate.

In the system of FIG. 1, microcomputer 32 does not control firing rate. Instead, master firing rate controller 16 provides this control. The system shown, therefore, is particularly well suited for retrofit to existing combustion systems with their already existing hardware to control firing rate. It should be recognized, however, that firing rate can also be controlled by digital computer 32. This is particularly advantageous in new systems as opposed to retrofit systems. In those embodiments in which microcomputer 32 also controls firing rate, microcomputer 32 supplies control signal which control the set points of oil and gas valves 18, 20 and the set point of air damper 24.

The system of the present invention which utilizes a digital computer to control on a feed forward basis, the excess air supplied to a combustion system, takes advantage of the great flexibility of the digital computer. Since control of excess air is based upon stored information, which can be varied at will when initially setting up the system, the control system of the present invention is useable with a wide range of different combustion equipment. Unlike the prior art systems, it does not require significant changes in hardware in order to be useable with a wide variety of different manufacturers' combustion equipment.

In conclusion, the system of the present invention provides efficient and complete combustion without requiring unneeded amounts of excess air. As a result, significant fuel cost savings are obtained by use of the system of the present invention. The system is highly flexible, simple to interface with existing combustion equipment, and yet provides highly accurate control of excess air.

Although the present invention has been described with reference to preferred embodiments, workers skilled in the art will recognize that changes may be made in form and detail without departing from the spirit and scope of the invention.

The embodiments of the invention in which an exclusive property or privilege is claimed are defined as follows:

1. A method of controlling air supplied to a combustion process, prior to actual combustion, in which fuel is supplied to the combustion process through a fuel supply line and air is supplied to the combustion process through an air supply line, the method comprising:

sensing fuel flow rate in the fuel supply line; sensing air flow rate in the air supply line;

determining a desired stoichiometric air flow rate as a function of the sensed fuel flow rate;

determining the firing rate of the combustion process as a function of sensed fuel flow rate;

determining a desired excess air flow rate from stored values of excess air required for the determined firing rate;

determining a desired total air flow rate from the desired stoichiometric air flow rate and from the desired excess air flow rate; and adjusting air flow in the air supply line as a function of the sensed air flow rate and the desired total air flow rate prior to the combustion process in an equal air flow percentage control action regardless of whether said firing rate is high or low, so that the trim action of said adjusting is greater at said high firing rate.

2. The method recited in claim 1 further comprising:

sensing the temperature in said air supply line; and correcting the sensed air flow rate for temperature.

3. The method recited in claim 1 further comprising:

sensing the temperature and pressure of fuel in said fuel supply line; and correcting the sensed fuel flow rate for temperature and pressure.

4. In a combustion system having a fuel supply line for supplying fuel and an air supply line for supplying air for combustion, a dynamic feed-forward control system comprising:

valve means for controlling fuel flow in the fuel supply line;

air flow control mans for controlling air flow in the air supply means;

firing rate control means for selecting set points for the valve means and the air flow control means based upon input signals, the set points representing a desired firing rate of the combustion system based upon the input signals;

fuel flow rate sensing means for providing a sensed fuel flow signal representative of a sensed fuel flow rate in the fuel supply line;

air flow rate sensing means for providing a sensed air flow signal representative of a sensed air flow rate in the air supply line;

air flow adjusting means for adjusting air flow in the air supply line as a function of a control signal;

means for determining a desired total air flow rate based only upon the sensed fuel flow rate, based upon stoichiometric air required for sensed flow rate, and based upon stored values of excess air as a function of fuel flow; and means for generating said control signal for said air flow adjusting means as a function of a comparison of the desired total air flow rate and the sensed air flow rate prior to the actual combustion process, said control signal producing an equal air flow percentage control action regardless of whether said firing rate is high or low, so that the trim action of said adjusting is greater at said high firing rate.

5. The system of claim 4 wherein the means for determining a desired total air flow rate comprises:

means for storing a desired excess air flow rate for each of a plurality of firing rate ranges;

means for determining a desired stoichiometric air flow rate as a function of the sensed fuel flow rate;

means for determining a firing rate as a function of the sensed fuel flow rate;

means for selecting the desired excess air flow rate stored for the firing rate range which corresponds to the sensed firing rate; and means for determining the desired total air flow rate as a function of the desired stoichiometric air flow rate and the desired excess air flow rate.

6. The system recited in claim 4 further comprising:

air temperature sensing means for providing a temperature signal representative of temperature in the air supply line; and wherein said digital computer has:

means for correcting the sensed air flow signal for temperature based upon said temperature signal.

7. The system recited in claim 4 further comprising:

temperature and pressure measuring means for providing signals representative of the temperature and pressure of said fuel in the fuel supply line; and wherein said digital computer has:

means for correcting said sensed fuel flow signal for temperature and pressure.

* * * * *